United States Patent [19]

Hartley et al.

[11] 4,024,916

[45] May 24, 1977

[54] BOREHOLE SEALING METHOD AND APPARATUS

[75] Inventors: James N. Hartley, Richland; George Jansen, Jr., Kennewick, both of Wash.

[73] Assignee: The United States of America as represented by the United States Energy Research and Development Administration, Washington, D.C.

[22] Filed: Aug. 5, 1976

[21] Appl. No.: 711,904

[52] U.S. Cl. ..... 166/288; 166/60; 166/302

[51] Int. Cl.[2] ..... E21B 33/10; E21B 33/13

[58] Field of Search ..... 166/288, 302, 60, 57; 175/11–17

[56] References Cited

UNITED STATES PATENTS

| | | | |
|---|---|---|---|
| 1,398,563 | 11/1921 | Nolan | 166/60 X |
| 1,898,926 | 2/1933 | Aarts et al. | 175/16 |
| 2,267,683 | 12/1941 | Johnston | 166/288 |
| 2,327,496 | 8/1943 | Burch | 175/13 |
| 2,363,269 | 11/1944 | Schlumberger | 166/288 |
| 3,208,530 | 9/1965 | Allen et al. | 166/288 X |
| 3,357,505 | 12/1967 | Armstrong et al. | 175/16 |
| 3,396,806 | 8/1968 | Benson | 175/16 X |
| 3,693,731 | 9/1972 | Armstrong et al. | 175/16 X |
| 3,907,044 | 9/1975 | Robertson | 175/16 |

*Primary Examiner*—Stephen J. Novosad
*Attorney, Agent, or Firm*—Dean E. Carlson; Arthur A. Churm; James W. Weinberger

[57] ABSTRACT

A method and apparatus is described for sealing boreholes in the earth. The borehole is blocked at the sealing level, and a sealing apparatus capable of melting rock and earth is positioned in the borehole just above seal level. The apparatus is heated to rock-melting temperature and powdered rock or other sealing material is transported down the borehole to the apparatus where it is melted, pooling on the mechanical block and allowed to cool and solidify, sealing the hole. Any length of the borehole can be sealed by slowly raising the apparatus in the borehole while continuously supplying powdered rock to the apparatus to be melted and added to the top of the column of molten and cooling rock, forming a continuous borehole seal. The sealing apparatus consists of a heater capable of melting rock, including means for supplying power to the heater, means for transporting powdered rock down the borehole to the heater, means for cooling the apparatus and means for positioning the apparatus in the borehole.

5 Claims, 1 Drawing Figure

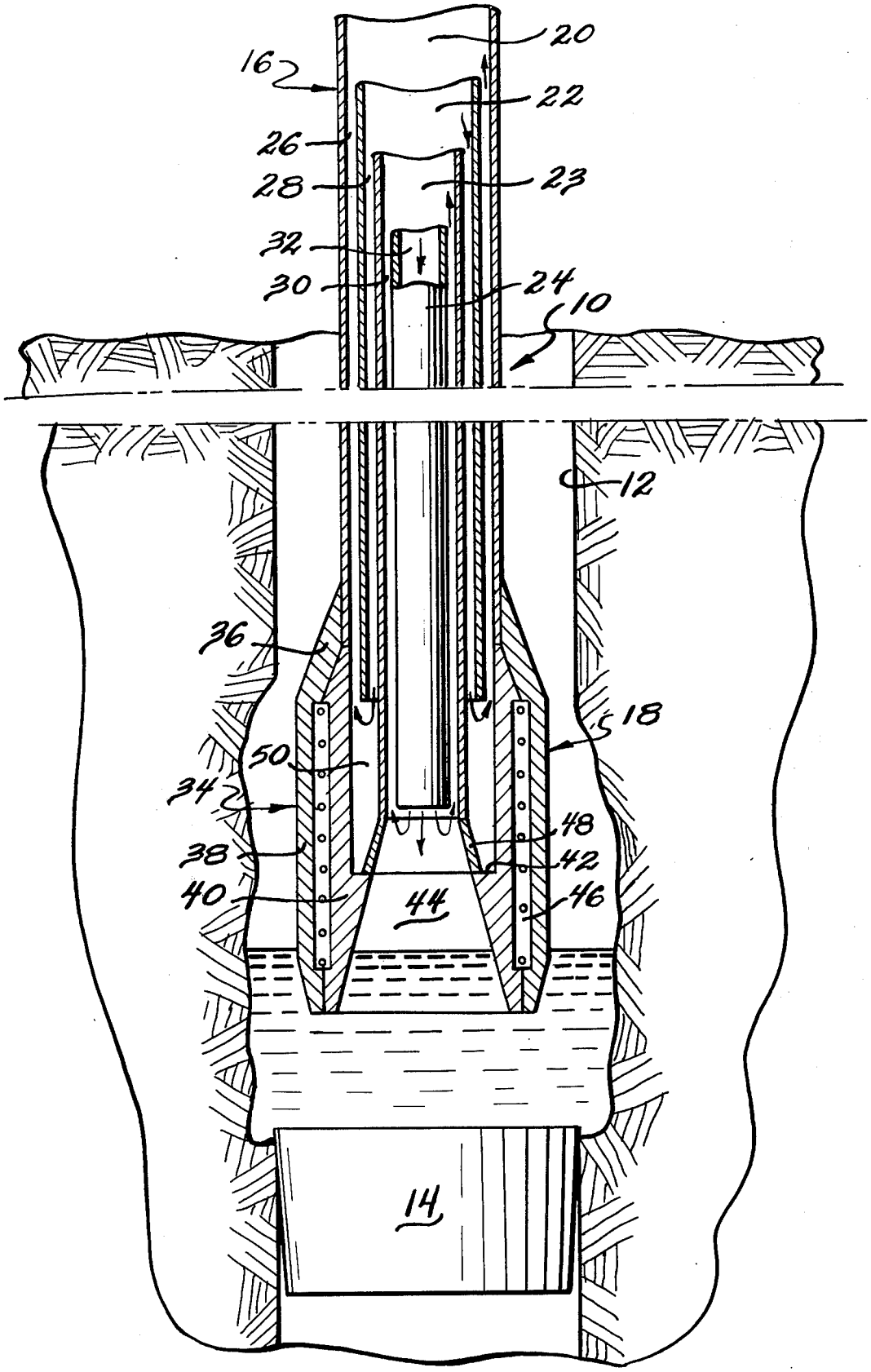
20
16
22
26
28
23
32
30
24
10
12
36
18
50
34
48
38
42
40
44
46
14

BOREHOLE SEALING METHOD AND APPARATUS

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

The invention relates to a method and apparatus for sealing boreholes in the earth. A major problem facing the nuclear industry which has received considerable attention is how to dispose of radioactive wastes so they will never contaminate the biosphere with radioactivity. It is believed that the disposal of radioactive wastes in geologic formations has the potential of isolating these wastes from man's environment for adequate time periods. Geologic environments exist which have been physically and chemically stable for millions of years, are isolatable from man's environment and have the potential to provide effective barriers between the waste and man's environment for the time periods required. Placement of solidified radioactive waste containing canisters in geologic formations, whether placed individually into boreholes or placed as a group in a rock cavity, will result in a penetration of the geologic environment with a potential for contact with man's environment. In order to assume the containment of nuclear waste by the geologic environment, these penetrations must be completely sealed in a manner that will afford the same level of integrity as the geologic environment prior to drilling the borehole.

The ability to seal cavities and drill holes is reasonably well developed for seals which maintain integrity on a short-term basis. For example, existing seals have been in place for 10 to 50 years rather than the hundreds of thousands of years required for waste disposal. In general, present-day plugging materials are various cements and clays. However, many problems can be encountered if the plugging is not carried out properly. For example, temperature affects the chemical reaction and the resulting characteristics of the cement. Cement sleeves are subjected to progressively higher temperatures from mixing to pumping into the hole and final cement curing. The cements must be able to withstand the temperature encountered during pumping and the static temperature after the hole is filled.

The quality of the plugging is also influenced by the nature of the drilling mud used during the drilling operation since this mud lines the walls and will likely weaken the bonding strength of the cement to the formation. Therefore it is essential that all circulatable mud be removed before plugging begins, thus increasing overall costs of the operation.

In some situations, such as opposite fresh water zones, casings are left in place and filled with cement; however, in time the casing may erode away, allowing a path to man's environment.

The only positive method to neutralize the boreholes is to restore the stratum to essentially its original strength, permeability and compatible chemical characteristics.

SUMMARY OF THE INVENTION

We have invented a method and apparatus for sealing boreholes in the earth which eliminates or minimizes most of the above problems and which provides a seal which will essentially restore the stratum to its original strength, permeability and compatible chemical characteristics.

By the method of our invention for sealing boreholes, the borehole is mechanically blocked at sealing level, and a sealing apparatus capable of melting rock and earth positioned in the borehole just above sealing level, the apparatus is heated to rock-melting temperature and sufficient powdered rock is transported down the borehole to the sealer which when melted, forms a pool of molten rock on the mechanical block filling the bottom of the borehole. The molten rock is then allowed to cool and solidify, thereby sealing the borehole. By slowly raising the sealer a predetermined distance in the borehole while continuously supplying sufficient additional powdered rock to the sealer to fill the borehole with molten material, any desired length of the borehole can be sealed.

The sealing apparatus of the invention consists of a heater capable of melting earth and rock, means for supplying power to the heater, means for transporting powdered rock down the borehole to the heater, means for cooling the apparatus and means for positioning and raising the apparatus in the borehole.

The concept of melting earth materials to form boreholes or small tunnels is taught by the prior art. For example, U.S. Pat. No. 3,357,505, issued to Armstrong et al., 1967, discloses an electrically heated earth drill, while U.S. Pat. No. 3,693,731, issued to Armstrong et al., 1972, describes a nuclear reactor heated earth boring machine.

It is therefore one object of this invention to provide a method and apparatus for permanently sealing boreholes in the earth.

It is the other object of this invention to provide a method and apparatus for permanently sealing boreholes in the earth by melting rock, earth or similar high-melting-temperature materials in the borehole.

BRIEF DESCRIPTION OF THE DRAWING

The drawing is a vertical cross-sectional view of the apparatus of the invention, in place in a borehole.

DESCRIPTION OF THE PREFERRED EMBODIMENT

Referring to the drawing, borehole sealer 10 of the present invention is shown in place in borehole 12 which has been temporarily sealed by a mechanical packer 14. Sealer 10 consists of an upper body portion 16 and a lower heating portion 18. Body portion 16 further consists of four concentric tubes, outer tube 20, first inner tube 22, second inner tube 23 and central tube 24 which in turn define annular coolant outlet 26, annular coolant inlet 28, annular air outlet 30, respectively, and central air and powdered rock inlet 32. Heating portion 18 consists of a tubular shaped outer melter 34 attached to the lower outer surface of outer tube 20 for melting the borehole wall having a downward flared portion 36 and a vertical portion 38 and a tubular shaped inner melter 40 extending downward from the bottom edge of outer tube 20, and attached to the inner surface of outer melter 34, for melting powdered rock or earth, and having an inwardly extending shoulder 42, defining an inner melting chamber 44. Sandwiched between outer melter 40 is annular shaped internal radiant heater 46 for supplying heat to the melters. Second inner tube 23 and central tube 24 extend downward below the edge of outer tube 20 into melting chamber 44. Tube 22 has an outward flared lower lip 48 which meets with inwardly extending shoulder 42 on inner melter 40 in sealed relation, forming cooling chamber 50 between the outer wall of tube 22 and the upper inner wall of heater 40, whereby cooling fluid passing downward through coolant inlet 28 passes through chamber 50 and upward through coolant outlet 26 to cool the apparatus. Powdered rock entrained in transport air is transported downward through air and rock inlet 32 to melting chamber 44 where the powder remains to be melted while the transport air returns to the surface through air outlet 30.

To operate the apparatus 10 to seal a borehole, a mechanical packer 14 is placed into position in the borehole 12 at the seal level to temporarily seal the borehole and to provide a base for the molten rock. Packer 14 may be any sort of temporary plug which can be placed in the borehole and which is capable of withstanding the temperature of the molten rock. The sealer 10 of the invention is then placed (by means not shown) into a position just above packer 14 and electric current supplied by power cables (not shown) is applied to radiant heater 46 which heats melters 34 and 40 to rock-melting temperature. Simultaneously a flow of coolant, such as water, is circulated through coolant inlet 28 into cooling chamber 50 and out coolant outlet 26 to maintain upper body 16 of the sealing apparatus at below melting temperature. As the wall of the borehole 12 reaches a temperature of about 1100° C. and begins to soften, a supply of powdered rock entrained in air is transported downward from a source of supply (not shown) through rock inlet 32 to melting chamber 44 where the powdered rock is disentrained from the air and remains in the chamber where it is melted while the air passes upwardly through annular outlet 30 to be recirculated. As the rock powder is melted, it pools on the surface of packer 14 and flows into contact with the softened borehole wall material so that as the molten material is allowed to cool and solidify the material will form a permanent bond with the borehole wall.

As the borehole above packer 14 is gradually filled with molten rock, the sealing apparatus is slowly and continuously raised (by means not shown), maintaining only the lower edge of heating portion 18 in the molten material while continuously supplying sufficient powdered rock to the sealer to fill the hole. In this manner, a section of hole many hundreds of feet long can be sealed by molten rock bonded securely to the partially melted wall.

While it is preferred that the wall of the borehole be melted along with the powdered rock in order to provide a better bond seal between the rock and the wall, a satisfactory seal can be provided without melting the wall since the molten material will flow into the fractures in the wall of the borehole, bonding the plug to the wall.

While powdered rock is described as the material to seal the borehole, any material such as sand, earth, resins, or glasses, such as borosilicate glass, which can be melted to provide a good seal with the walls of the borehole can be used for the purposes of this invention.

The mechanical packer may be any expandable sealing device which can be placed in the borehole at the desired level, such as a Laynes production-injection packer. It may be necessary to provide a few inches of earth or other insulating material on the packer to protect it from the molten sealing material.

Materials from which the melter can be constructed are well known and have been discussed in the U.S. patents cited supra. For example, the resistance heater can be constructed of tungsten, while the inner and outer annular melters can be constructed of heat-resistant material such as boron nitride. The upper body portion can be constructed of less expensive heat-resistant material such as molybdenum or vanadium.

The amount of heat which must be provided will depend upon the composition of the borehole wall. The melting points of most common siliceous minerals is from about 1,100° to 1,500° C. so that the melter will be required to provide a temperature somewhat above the highest melting temperature of the surrounding material. For example, to seal a 6-inch borehole in siliceous soil at a rate of 10 feet per hour will require somewhat less than 10 kilowatts.

The horizontal cross-sectional shape of the melter will generally be circular to match the shape of the borehole, although it is only important that it match the shape of the borehole. The size should be just slightly smaller than the borehole to be sealed so that the wall may not be at least softened by the melter to facilitate a seal between the molten rock and the side wall.

The supply of circulating cooling fluid and the supply of air-entrained powdered rock and other utility services can be supplied to the sealing apparatus from the surface of the earth by any methods well known to those skilled in the art, such as by flexible conduits, cables, etc.

It will be understood that the method and apparatus of the invention for sealing boreholes in the earth are not to be limited to the details given herein, but may be modified within the scope of the appended claims.

The embodiments of the invention in which an exclusive property or privilege is claimed as follows:

1. A method for permanently sealing a borehole in the earth comprising:

mechanically blocking the borehole at sealing level;

positioning a sealing apparatus capable of melting rock and earth in the borehole just above seal level;

heating the sealing apparatus to rock and earthmelting temperature;

supplying sufficient rock to the sealing apparatus which, when melted, forms a pool of molten material on the mechanical block filling the bottom of the borehole and cooling the molten material to below melting temperature whereby it solidifies, thereby sealing the borehole.

2. The method of claim 1 including the step of slowly raising the apparatus in the borehole a predetermined distance while continuing to supply sufficient rock to the apparatus to fill the borehole with molten material which, when cooled and solidified, will continuously seal the borehole the predetermined distance.

3. A high-temperature apparatus for sealing boreholes with molten rock and earth comprising:

a. an elongated tubular body having a lower end;

b. a relatively short tubular melter extending downward from the lower end of the body defining an inner melting chamber, said melter having a tubular shaped electrically powered heater capable of providing sufficient heat to melt rock and earth, an outer melter around the outer surface of the heater for transferring heat to and melting the walls of the borehole and an inner melter around the inner surface of the heater for transferring heat to and melting rock and earth in the inner melting chamber;

c. means for supplying electrical power to the heater;

d. means for cooling the apparatus, including means for supplying coolant to the apparatus;

e. means for positioning the apparatus in a borehole; and f. means for supplying air entrained powdered rock and earth to the inner melting chamber.

4. The apparatus of claim 3 wherein the tubular body contains a first concentric inner tube extending slightly below the lower end of the tubular body, said first tube having a slightly smaller diameter than the body, defining a first annular space therebetween for the passage of coolant from the apparatus, a second concentric inner tube within the first tube, said second tube having a slightly smaller diameter than the first tube, defining a second annular space therebetween for the passage of coolant into the apparatus, said second tube having a lower end extending below the lower end of said first tube and having an outwardly flared lip joined to the upper portion of the inner melter in sealing relationship therewith to define an annular-shaped cooling chamber communicating with the first and second annular spaces for the passage of coolant therethrough for cooling the apparatus, and a concentric central tube within said second tube defining a central space, said central tube having a slightly smaller diameter than said second tube, a third annular space therebetween, said central space and said third annular space being in communication with said melting chamber, one said space for supplying air entrained powdered rock into said chamber, the other said space being an air return.

5. The apparatus of claim 4 wherein the heater is tungsten and the inner and outer melters are boron nitride.

* * * * *